US011293238B2

(12) United States Patent
Tørresvold et al.

(10) Patent No.: US 11,293,238 B2
(45) Date of Patent: Apr. 5, 2022

(54) DRILLING SYSTEM FOR ROCK DRILLING

(71) Applicant: National Oilwell Vareo Norway AS, Kristiansand S (NO)

(72) Inventors: Audun Tørresvold, Kristiansand (NO); Roar Berge, Kristiansand S (NO)

(73) Assignee: National Oilwell Vareo Norway AS

( * ) Notice: Subject to any disclaimer, the term of this patent is extended or adjusted under 35 U.S.C. 154(b) by 0 days.

(21) Appl. No.: 16/626,765

(22) PCT Filed: Jun. 15, 2018

(86) PCT No.: PCT/NO2018/050160
§ 371 (c)(1),
(2) Date: Dec. 26, 2019

(87) PCT Pub. No.: WO2019/004836
PCT Pub. Date: Jan. 3, 2019

(65) Prior Publication Data

US 2020/0131868 A1 Apr. 30, 2020

(30) Foreign Application Priority Data

Jun. 28, 2017 (EP) ..... 17178322

(51) Int. Cl.
*E21B 19/22* (2006.01)
*E21B 17/20* (2006.01)
(Continued)

(52) U.S. Cl.
CPC ..... *E21B 19/22* (2013.01); *E21B 17/20* (2013.01); *E21B 19/004* (2013.01); *E21B 19/09* (2013.01); *E21B 19/143* (2013.01)

(58) Field of Classification Search
CPC ..... E21B 19/22; E21B 19/004; E21B 19/09; E21B 19/143; E21B 19/02; E21B 17/20
See application file for complete search history.

(56) References Cited

U.S. PATENT DOCUMENTS 2,100,684 A 11/1937 Carroll
2,105,722 A 1/1938 Barrett
(Continued)

FOREIGN PATENT DOCUMENTS

DE 102010049415 2/2012
DK 201470227 8/2015
(Continued)

OTHER PUBLICATIONS

IPRP dated Sep. 27, 2019 for PCT/NO2018/050160 (12 pages).
(Continued)

*Primary Examiner* — Nicole Coy
*Assistant Examiner* — Yanick A Akaragwe
(74) *Attorney, Agent, or Firm* — Conley Rose, P.C.

(57) ABSTRACT

Disclosed is a drilling system for rock drilling with a drill string, wherein the drill string includes at least one bendable drill pipe. The drilling system further includes at least two block and tackle systems for driving an end of the drill string in a first direction; and at least two conveyor devices adapted to guide and bend the drill string between the first direction and a second direction, so as to convert a motion of the drill string between the first direction and the second direction.

25 Claims, 11 Drawing Sheets

(51) Int. Cl.

| | |
|---|---|
| ***E21B 19/00*** | (2006.01) |
| ***E21B 19/09*** | (2006.01) |
| ***E21B 19/14*** | (2006.01) |

(56) References Cited

U.S. PATENT DOCUMENTS

| | | | | |
|---|---|---|---|---|
| 2,548,616 | A * | 4/1951 | Priestman | E21B 19/22 175/103 |
| 3,667,554 | A * | 6/1972 | Smitherman | E21B 19/22 175/57 |
| 3,677,345 | A | 7/1972 | Sizer | |
| 4,223,727 | A | 9/1980 | Sustek | |
| 4,774,694 | A * | 9/1988 | Moll | E21B 47/18 367/83 |
| 5,803,168 | A * | 9/1998 | Lormand | E21B 19/22 166/77.2 |
| 5,857,530 | A | 1/1999 | Gronseth | |
| 6,250,395 | B1 * | 6/2001 | Torres | E21B 17/20 166/382 |
| 6,508,311 | B1 * | 1/2003 | Torres | E21B 17/20 166/117.5 |
| 9,523,244 | B2 | 12/2016 | Heisig | |
| 2006/0283633 | A1 | 12/2006 | Benge | |
| 2011/0284292 | A1 | 11/2011 | Gibb | |
| 2012/0186875 | A1 | 7/2012 | McDougall | |
| 2014/0102800 | A1 | 4/2014 | Lacour | |
| 2017/0002612 | A1 * | 1/2017 | Boone | E21B 3/02 |

FOREIGN PATENT DOCUMENTS

| | | |
|---|---|---|
| WO | WO0133028 | 5/2001 |
| WO | WO2004079149 | 9/2004 |
| WO | WO2014057507 | 4/2014 |

OTHER PUBLICATIONS

International Search Report and First Written Opinion dated Aug. 13, 2018 for PCT/NO2018/050160 (8 pages).

Second Written Opinion dated May 22, 2019 for PCT/NO2018/050160 (5 pages).

Response to Written Opinion dated Aug. 13, 2018 filed on Mar. 12, 2019 for PCT/NO2018/050160 (5 pages).

Extended European Search Report dated Sep. 27, 2017 for EP Appllication 17178322.8 (7 pages).

* cited by examiner

DRILLING SYSTEM FOR ROCK DRILLING

CROSS REFERENCE TO RELATED APPLICATIONS

This application is a 35 U.S.C. § 371 national stage application of PCT/NO2018/050160 filed Jun. 15, 2018 and entitled "Drilling System for Rock Drilling", which claims priority to European Patent Application No. 17178322.8 filed Jun. 28, 2017, each of which is incorporated herein by reference in their entirety for all purposes.

STATEMENT REGARDING FEDERALLY SPONSORED RESEARCH OR DEVELOPMENT

Not Applicable.

FIELD OF THE DISCLOSURE

This disclosure relates to a drilling system for rock drilling.

BACKGROUND

A usual solution for creating a hole in the earth's subsurface is a drilling system for rock drilling. It can be used, for instance, when drilling water wells, oil wells, or natural gas extraction wells. A typical task performed during a drilling operation is pulling the drill string out of a wellbore and then running it back in. This task is commonly referred to as "tripping" or making a "round trip." There are multiple reasons for performing such a task, for example to perform a casing operation or a cementing operation after a certain depth has been reached. Other reasons may be to replace a worn-out drill bit, a downhole tool that might have broken down or a damaged drill pipe.

The task of performing a round trip is known to be time consuming. The entire drill string needs to be removed from the wellbore and its drill pipes need to be disconnected and stored, usually in a rack, until they are connected together again to form the drill string to be run back in. A way to improve the efficiency of a round trip is disconnecting the drill string only in some of the joints when the drill string is pulled out of the wellbore, so as to form at least one segment with a length of at least two drill pipes. These segments, usually referred to as "stands," may be then stored until they are reconnected together for being run back in. As a consequence, a lower number of joints are disconnected, when the drill string is being pulled, and also a lower number of respective joints are connected, when the drill string is being run back in. Only the joints between the segments of a drill string need to be disconnected and connected, which reduces the time needed for disconnecting and connecting drill pipes.

The ability to store a longer segment of a drill string when performing a round trip allows improving the efficiency of a round trip, which can, for example, represent a significant reduction in operation costs. However, it may be challenging to store longer segments of a drill string in a drilling system, in a cost efficient and stable manner.

Nowadays, a drilling system adapted to store segments of the drill string, for the purpose of reducing the round trip duration, usually includes a hoisting structure such as a derrick. The segments are normally held in a vertical rack next to the hoisting structure. A well-known approach for storing longer segments in these drilling systems involves increasing the height of the hoisting structure in order to provide room for longer segments. For example, a drilling system with a 64-meter derrick is usually capable of holding segments with 40 meters in length, typically up to four drill pipes in length. However, several difficulties are observed due to the increased height. Since the segments of the drill string are longer and heavier, stronger equipment may be needed. Moreover, since the equipment supported by the hoisting structure is further elevated, security risks also increase and it also becomes more difficult to provide maintenance for the equipment due to the increased difficulty in reaching it. Also, a higher hoisting structure and the machinery required for handling longer segments becomes significantly heavier. For example, a usual derrick capable of holding segments of a drill string with three drill pipes in length can weight, approximately, 30 metric tons, whereas a usual derrick capable of holding segments of a drill string with four drill pipes in length can weight, approximately, 100 metric tons. The difficulties resulting from the increased weight supported by the hoisting structure or its higher centre of mass, are normally solved by appropriately reinforcing the hoisting structure and altering it to have the required robustness. However, this change has a cost which may be significant.

In particular, in the case of a maritime vessel comprising a drilling system with a hoisting structure, for example a drillship, it is possible that the maritime vessel itself is prone to suffer disturbances due to the motion produced by the waves or due to the wind, such as disturbances in the roll axis of the maritime vessel, thus creating additional difficulties in the stability of the maritime vessel. Moreover, the increased height may also forbid the maritime vessel from entering certain important maritime passages such as the Panama canal, in which the maximum height allowed is 57 meters (190 feet), and the Turkish straits, in which the maximum height is 64 meters (210 feet).

Thus, although the well-known approach of reducing the usual duration of a round trip in a drilling system by increasing the height of a hoisting structure has proven to be an effective solution in the past, nowadays several technical and economical drawbacks are observed due to the increased height. And these drawbacks may make it unfeasible to keep on following this approach, which constraints the achievable reduction for the duration of a round trip.

Alternatively, instead of increasing the length of the segments of a drill string held temporarily while performing a round trip, the approach may be to provide the drilling system with equipment which would allow to manoeuvre the segments faster. This approach would not reduce the number of joints between drill pipes that have be disconnected and connected during a round trip. Also, this may add a significant cost, not only for the new equipment but also for any reinforcement required to withstand the additional forces in place, and the reduction in the duration of a round trip may be insufficient to compensate for this investment.

SUMMARY OF DISCLOSURE

Apparatus, systems, and methods described herein go against the conventional approach of increasing the height of a hoisting system comprised in a drilling system in order to reduce the duration of a round trip.

Disclosed is a drilling system for rock drilling with a drill string, wherein the drill string comprises at least one bendable drill pipe, the drilling system comprising:

at least two block and tackle systems for driving an end of the drill string in a first direction; and at least one conveyor device adapted to guide and bend the drill string between the first direction and a second direction, so as to convert a motion of the drill string between the first direction and the second direction.

In some embodiments, the at least one conveyor device may be two conveyor devices for guiding the drill string in a curved path between the first direction and the second direction.

In some embodiments, a conveyor device may comprise at least two rollers for guiding the drill string.

In some embodiments, a conveyor device may comprise a groove for the drill string to run on.

In some embodiments, the second direction may be arranged vertically.

In some embodiments, the first direction may be arranged horizontally.

In some embodiments, the first direction may be arranged with an inclination relative to a horizontal plane.

In some embodiments, the drilling system may comprise a top drive for exerting a torque around the first direction on the end of the drill string.

In some embodiments, the drilling system may comprise at least one rack for holding at least one segment of the drill string while performing a round trip, the rack being arranged parallel to the first direction.

Also disclosed is a maritime vessel comprising at least one drilling system as described above.

In some embodiments, the first direction of the at least one drilling system on the maritime vessel may be arranged longitudinally in relation to the maritime vessel.

In some embodiments, the maritime vessel may comprise at least two drilling systems arranged vertically on top of each other. In some embodiments, the at least two drilling systems may have a common second direction.

In some embodiments, the maritime vessel may be a drillship and in other embodiments, the maritime vessel may be an oil and gas platform.

The apparatus, systems, and methods described herein may be advantageous in various ways as will be apparent from the description throughout. Particularly, that which is disclosed herein may reduce the duration of a round trip by allowing the manipulation of longer segments of a drill string, in a feasible manner, which in turn may represent a significant reducing in project costs. For example, drilling system which is capable of handling a segment of the drill string with at least 5 bendable drill pipes can be achieved without imposing a significant increase in cost, as it would occur for a drilling system with a hoisting structure such as a derrick.

DETAILED DESCRIPTION OF THE DISCLOSED EXEMPLARY EMBODIMENTS

Figure 1:
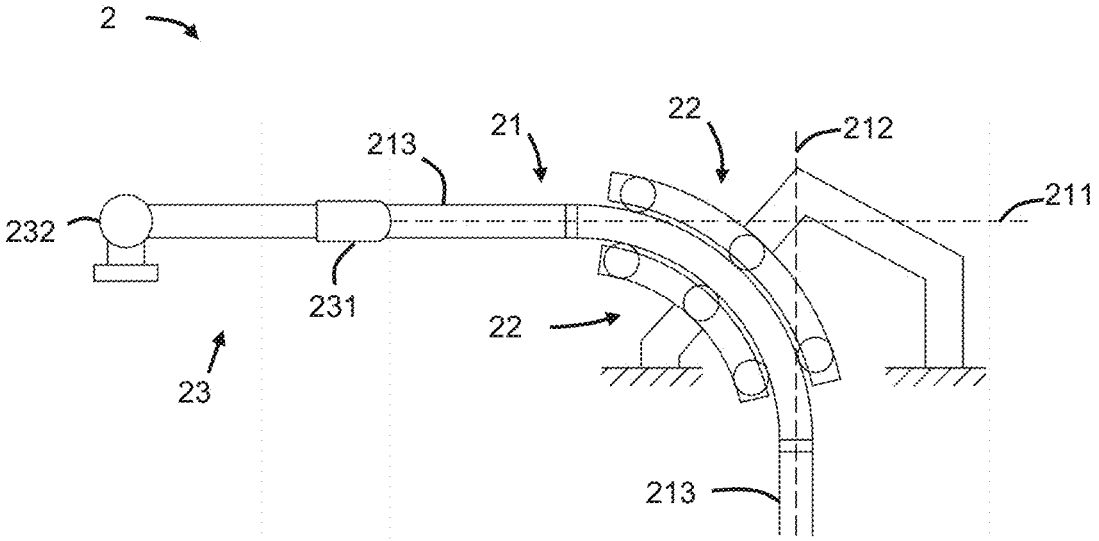
FIG. 1 is an illustration of a first embodiment of a drilling system observed from a side view, in which a drill string can be seen being guided and bent between a first direction and a second direction.

FIG. 1 illustrates a first embodiment of a drilling system 2 for rock drilling with a drill string 21.

The drill string 21 is shown in its state during operation, being bent between a first direction 211 and a second direction 212. For the purposes of providing a simple example, the first direction 211 and the second direction 212 are arranged with an inclination of 90 degrees. The first direction 211, horizontal, may be imagined as corresponding to the deck of a drill ship 11 and the second direction 212, vertical, may be imagined as corresponding to the direction on which a wellbore is to be drilled.

An end of the drill string 21 is driven along the first direction 211. There are several ways of accomplishing this actuation. One way is to use two block and tackle systems 23 for driving the drill string 21 back and forth in the first direction 211, in which one of the systems exerts tension on the drill string 21 so as to pull it from the wellbore and another exerts tension on the drill string 21 so as to push it. In FIG. 1, only the block and tackle system 23 for pulling the drill string 21 is shown. This block and tackle system 23 includes a traveling block 231 and a fixed block 232, each including at least one pulley, with a cable threaded between them. Also, a block and tackle system 23 may include a winch 233 for the purpose of driving the cable. Instead of two block and tackle systems 23, a winch and one long wire may be provided. In this case, the wire is connected to both ends of the travelling block 231 via sheaves and the winch acts in similar manner to a windlass. Furthermore, a further option is to use a rack and pinion system.

The drill string 21 is guided and bent between the first direction 211 and the second direction 212 by two conveyor systems 22 which guide the drill string 21 in a curved path. As a result, a motion of the drill string 21 is converted between the first direction 211 and the second direction 212.

In order to carry out the first embodiment when starting from a drilling system 2 without any drill string 21, the following approach may be followed. A first bendable drill pipe 213 is firstly pushed along the first direction 211 into the space between the two conveyor devices 22. During this motion, the first bendable drill pipe 213 should be guided and bent towards the second direction 212. Secondly, after the first bendable drill pipe 213 reaches a position which allows for a subsequent bendable drill pipe 213 to be added in the first direction 211, the first bendable drill pipe 213 is fastened in order to prevent its movement relative to the two conveyor devices 22, for example by using slips to hold the first bendable drill pipe 213 or any other known method for that effect. Then, an end of the subsequent bendable drill pipe 213 is joined with the end of the first bendable drill pipe 213 in the first direction 211, as to form a drill string 21 which is now pushed into the two conveyor devices 22 until it is again possible for a second subsequent bendable drill pipe 213 to be added to the drill string. This cycle is repeated to further extend the drill string. Furthermore, this way of carrying out the first embodiment may start from a segment of a drill string 21 with more than one bendable drill pipe 213 in length, instead of starting with an individual bendable drill pipe 213.

With the drill string 21 in place, the extending and retracting the drill string 21 may be achieved in the following ways. On the one hand, the steps of pushing the drill string 21 through the two conveyor devices 22 and adding a subsequent bendable drill pipe 213 when possible, may be repeated for extending the drill string 21 until an intended depth is reached. On the other hand, the loop for extending the drill string 21 may be performed in reverse and each of the disconnected bendable drill pipes 21 or each of the disconnected segments of the drill string, can be stored one by one.

Figure 2:
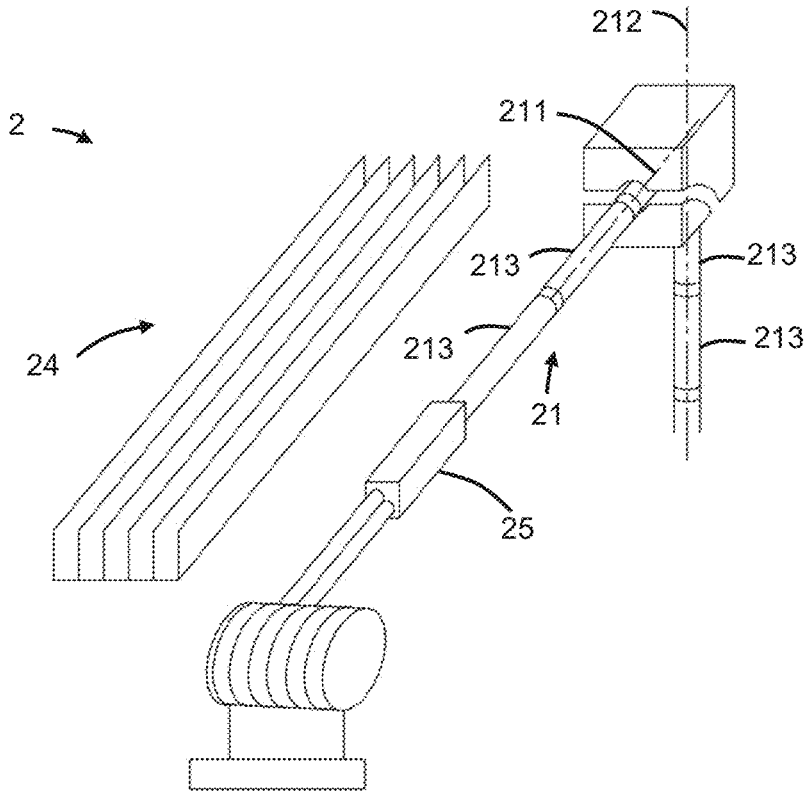
FIG. 2 is an illustration of a second embodiment of the drilling system showing how a round trip can be performed while temporally storing longer segments of the drill string.

FIG. 2 illustrates a second embodiment of the drilling system 2 in which the first embodiment includes a rack 24 for holding at least one segment of the drill string 21 and also, in which the rack 24 is arranged to hold the at least one segment of the drill string 21 parallel to the first direction 211.

The rack 24 can be used, for example, in the same manner a setback is used in a drilling system 2 with a derrick, by storing segments of a drill string 21 temporally while making a round trip. In order to move the bendable drill pipes 213 or the segments of a drill string 21 to and from the rack 24, other external means may be used, such a crane or at least one robotic arm.

A drilling operation may be performed by applying a torque to the drill string 21. In this second embodiment, the torque is exerted on the drill string 211 around the first direction 211, which then transmits the torque, through the drill string 21, to the second direction 212. In order to apply this torque around the first direction 211, a top drive 25 is provided at an end of the drill string 21 in the first direction 211.

Figure 3:
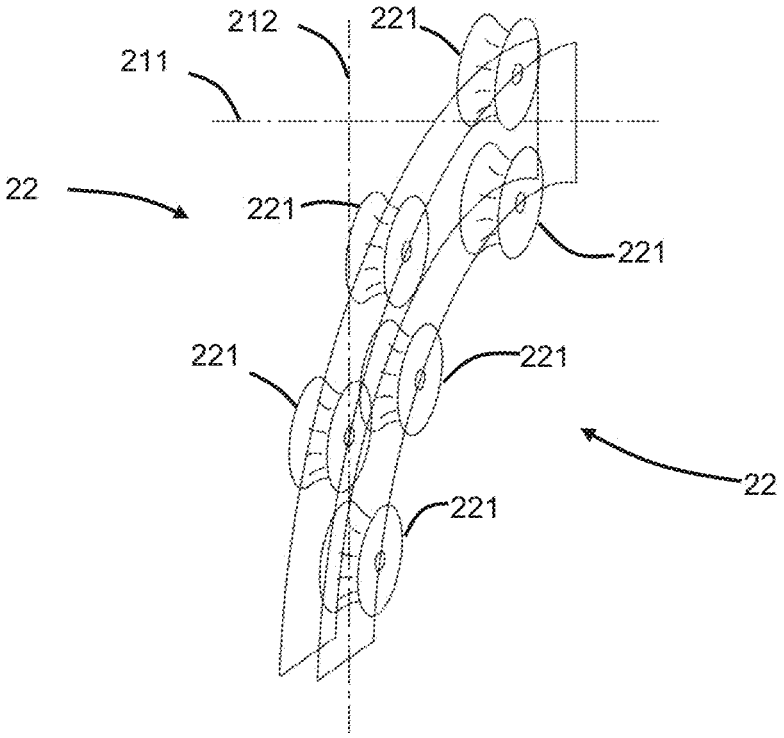
FIG. 3 is an illustration of an embodiment of two conveyor devices for guiding the drill string in curved path between the first direction and the second direction.

FIG. 3 illustrates an embodiment of two conveyor devices 22 for guiding and bending the drill string 21.

Each of the conveyor devices 22 include three rollers 221 supported by a curved frame. Each roller 221 is of the "bow tie" type, which provides a better contact with the drill string 21. Particularly, these rollers 221 allow to bend the drill string 21 between the first direction 211 and the second direction 212 while it moves back and forth, or even if it turns, for example while drilling.

Figure 4:
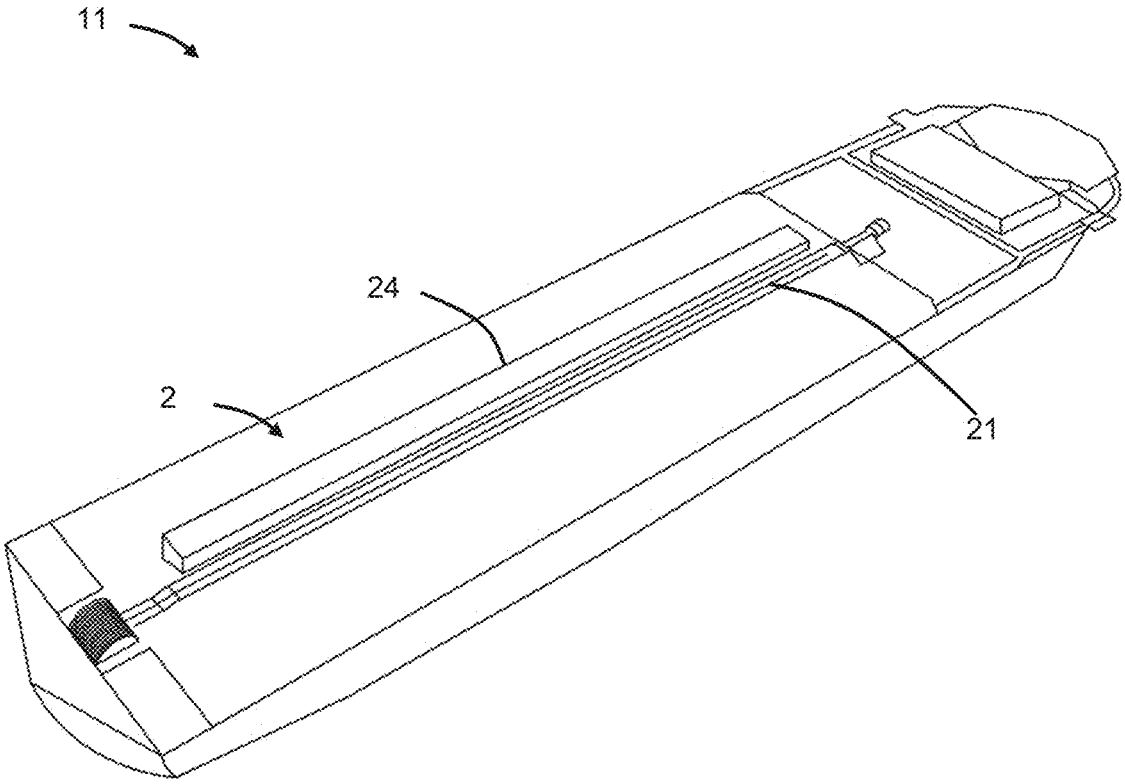
FIG. 4 is an illustration of a drill ship from including an embodiment of the drilling system in which the first direction of the drilling system is arranged longitudinally relative to the drill ship.

FIG. 4 illustrates a drill ship 11 including an embodiment of the drilling system 2 in which the first direction 211 of the drilling system 2 is arranged longitudinally relative to the drill ship 11. Also, the drilling system 2 is shown comprising a rack 24 which is arranged to hold at least one segment of the drill string 21 in parallel to the first direction 211.

Figure 5:
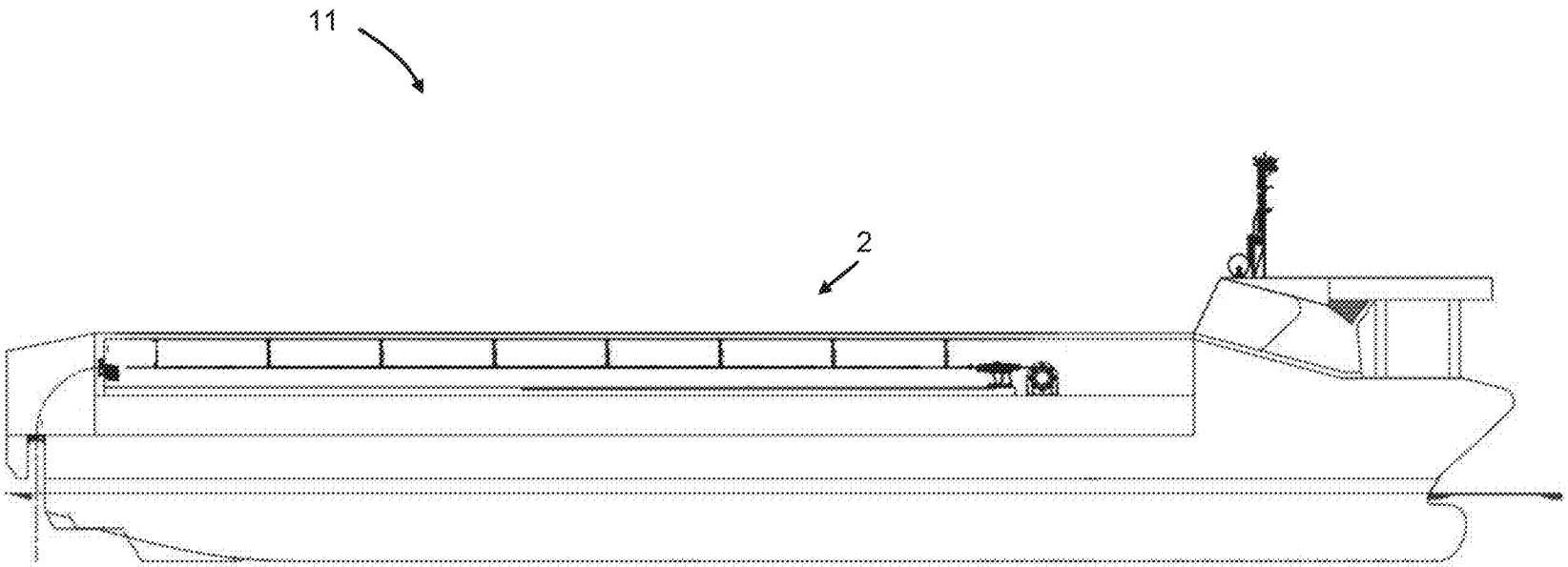
FIGS. 5, 6, and 7 illustrate three examples of arrangements of a drilling system on a drill ship.
Figure 6:
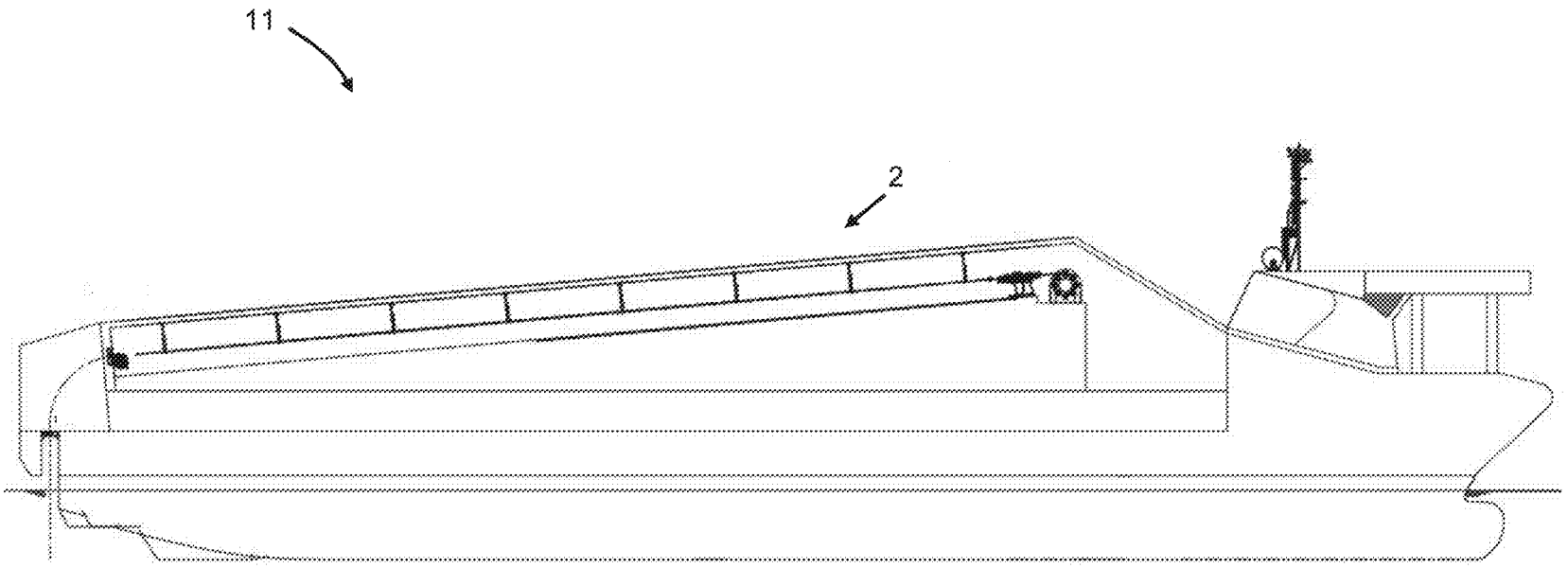
Figure 7:
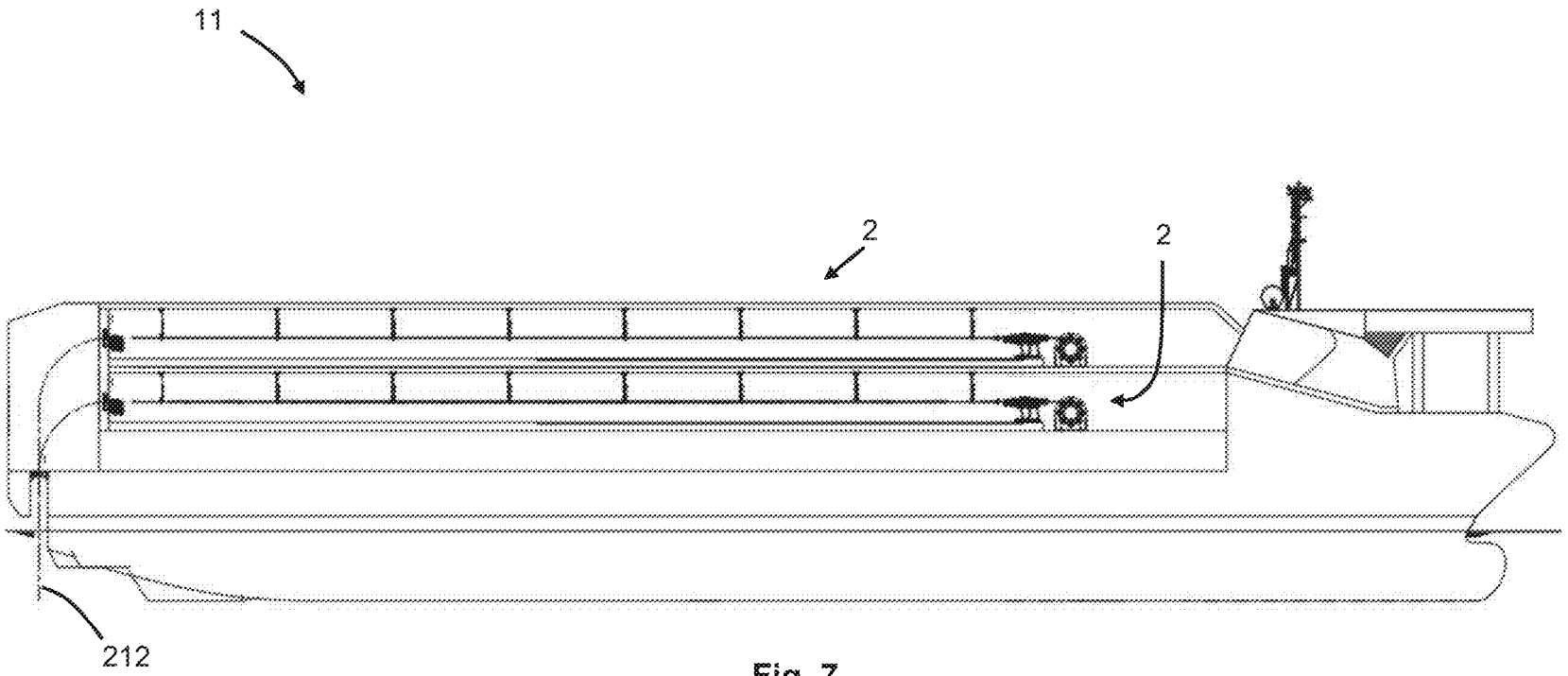

Three examples of an arrangement of the drilling system 2 on a drill ship 11 are shown in FIGS. 5, 6 and 7.

FIG. 5 shows an embodiment of the drill ship 11 where the two conveyor devices 22 are positioned near the bow of the drill ship 11.

FIG. 6 shows an embodiment of the drill ship 11 in which the first direction 211 of the drilling system 2 is sloped in relation to the drill ship 11. This embodiment can have the advantage of providing a simpler block and tackle system 23 which makes use of the gravity force to move the drill string 21 and, at the same time, still avoids the problems created by a drilling system 2 with hoisting structure.

FIG. 7 shows an embodiment of the drill ship 11 in which the drill ship 11 has two drilling systems 2, in which one is on top of the other. The second direction 212 is common to both drilling systems 2. Also, the curved path achieved by the conveyor devices 22 used in each drilling system 2 have different radiuses. This has the advantage of allowing different bend radiuses for different tubular types, for example steel or composite tubular, and dimensions of the bendable drill pipes 213. For example, the drilling system 2 on the top can be set to handle bendable drill pipes 213 with a longer diameter, thus requiring a bigger bend radius, such as a 20-meter radius, as opposed to the drilling system 2 on the bottom which can be set to handle bendable drill pipes 213 with a shorter diameter, thus requiring a smaller bend radius, such as a 10-meter radius.

In order to improve the efficiency of a round trip by increasing the length of the stored segments of a drill string 21, a drill ship 11 may be occupied in a longitudinal manner. In this regard, a segment of a drill string 21 can have, for example, up to 500 feet, i.e. approximately 152.4 meters. As can be seen on, for example, FIG. 4, the drilling system 2 occupies almost the entire length of the drill ship 11. Due to this longitudinal occupation of the drill ship 11, rather than vertical, the amplification of disturbances on the drill ship 11, due to waves or wind, is not felt. A higher structure can be prone to absorb disturbances from wind, acting as a sail, which can create difficulties in keeping the drill ship 11 stable. Also, a higher structure raises the centre of mass of the entire body comprising the drill ship 11 plus the drilling system 2, which can create difficulties in keeping the drill ship 11 stable due to the motion of the waves.

Figure 8:
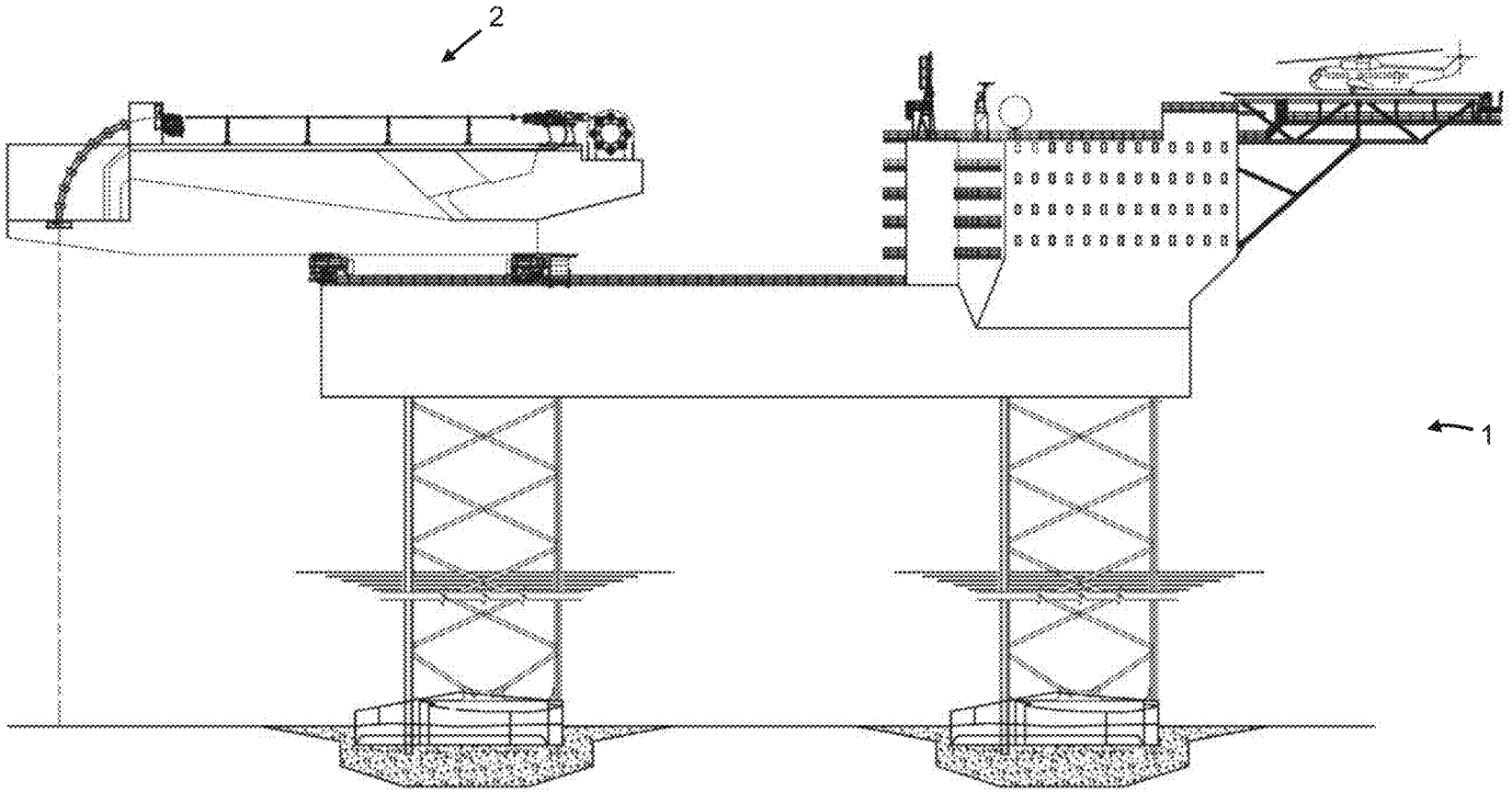
FIGS. 8 and 9 are illustrations of a jack-up rig including a drilling system.
Figure 9:
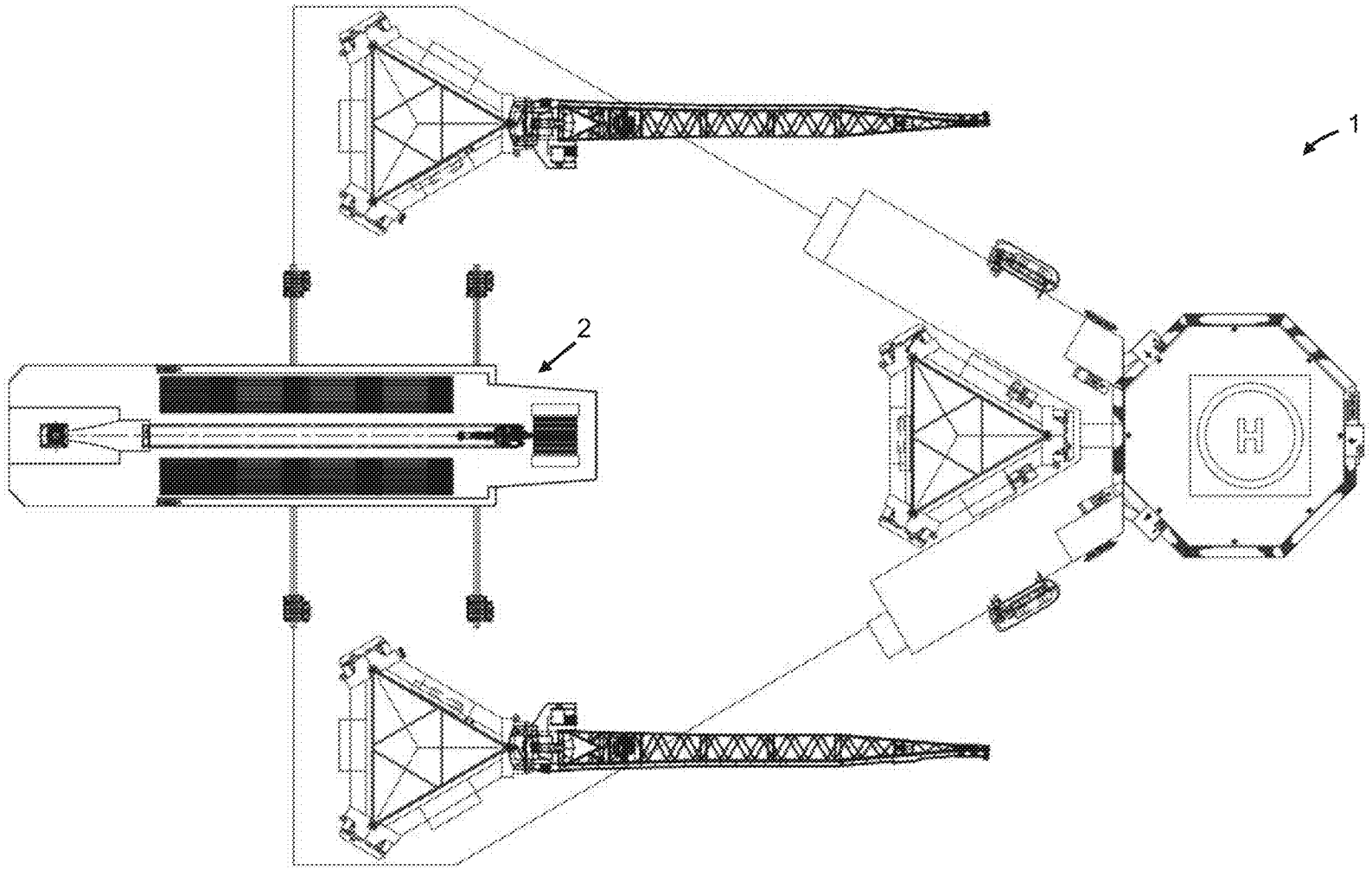
Figure 10:
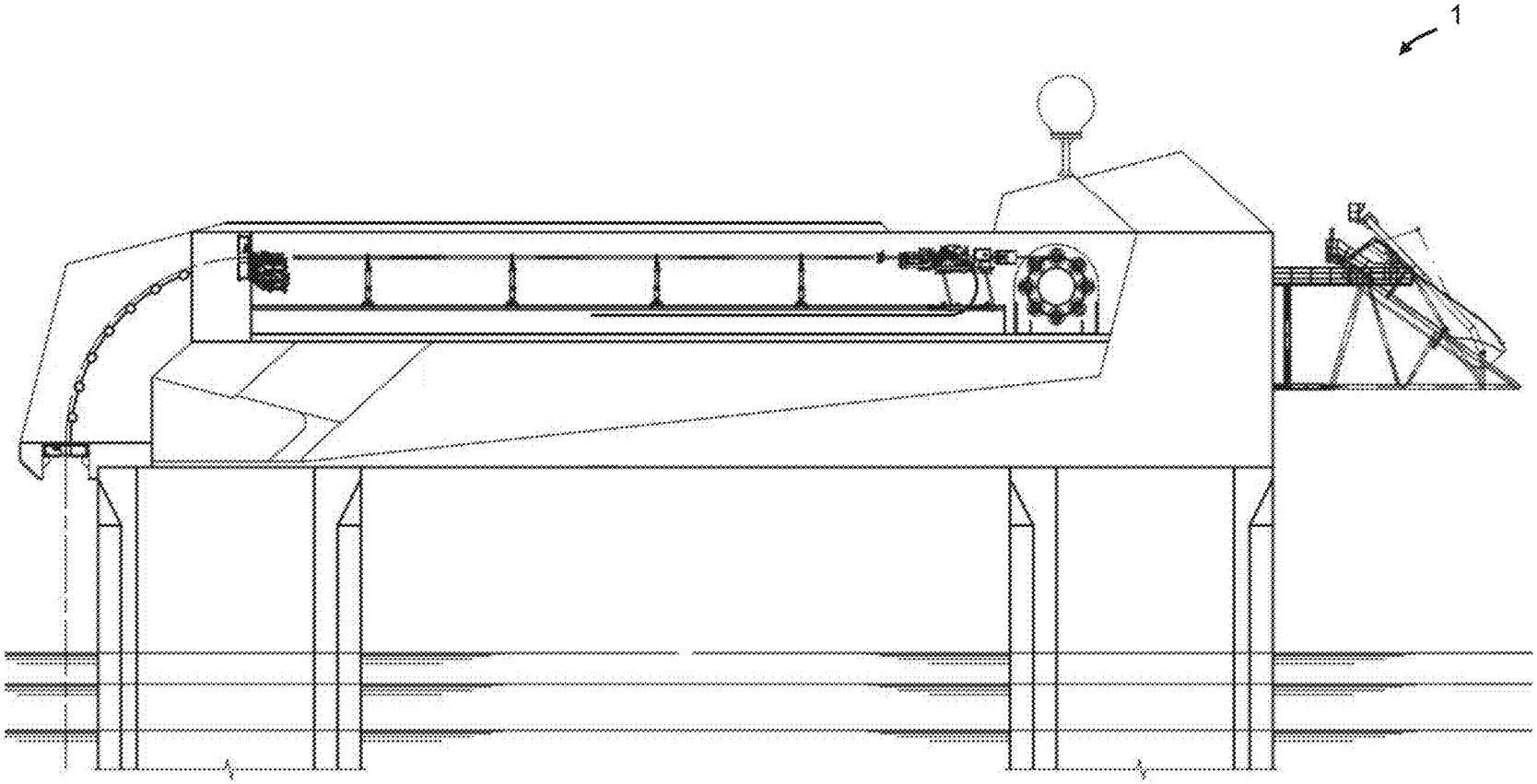
FIGS. 10 and 11 are illustrations of an oil and gas platform including a drilling system.
Figure 11:
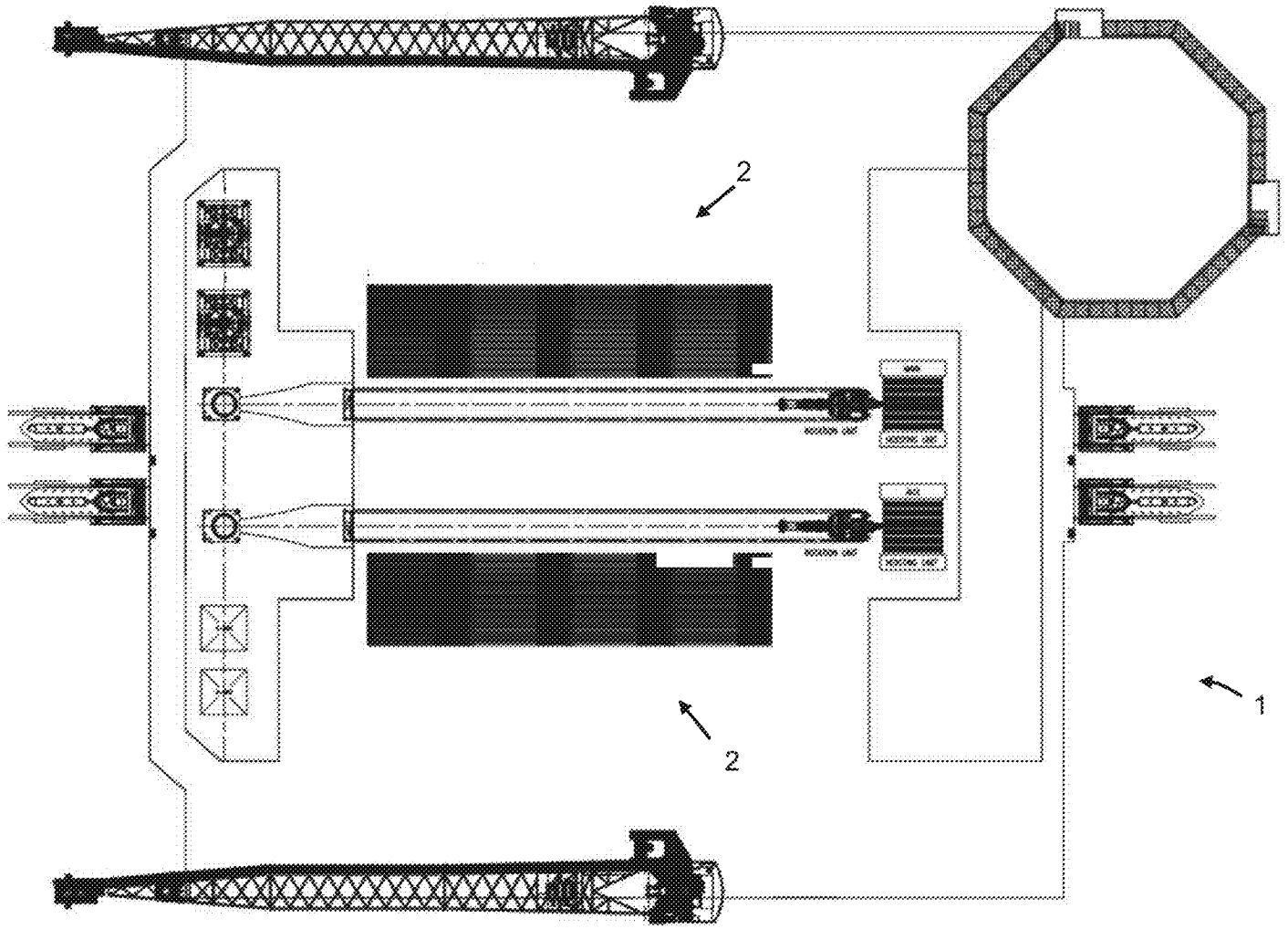

FIGS. 8, 9, 10, and 11 show two embodiments of different kinds of a maritime vessel 1 including drilling system 2 according to the present disclosure. FIGS. 8 and 9 show a jack-up rig and FIGS. 10 and 11 show an oil and gas platform.

The embodiment shown in FIGS. 10 and 11 for an oil and gas platform includes two drilling systems 2 positioned side-by-side. This particular arrangement allows achieving further improvements to the efficiency of a round trip. If a drill string is being pulled out of a wellbore using one drilling system 2, another drill string can be ready on the other drilling system 2 to be run in into the wellbore.

A further simplification can be achieved by providing a shared rack 24 when there is more than one drilling system 2 proximal to each other. For example, in FIG. 11 a single rack 24 could be positioned between the two drilling systems 2 shown, serving both of them. The same could happen in FIG. 7, where both drilling systems 2 could make use of a same rack 24 for holding at least one segment of a drill string 21.

It should be noted that the above-mentioned ways of carrying out the invention defined by the claims that are set out below illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The invention claimed is:

1. A drilling system for drilling a well bore with a drill string, wherein the drill string comprises at least one bendable drill pipe, and wherein the drilling system is adaptable for being onboard a maritime vessel and comprises:

at least two block and tackle systems arranged along a first direction for driving an end of the drill string in the first direction; and at least two conveyor devices adapted so that the drill string is guided and bent by the at least two conveyor devices between the first direction and a second direction, wherein the second direction is both different than the first direction and aligned with the well bore.

2. The drilling system according to claim 1, wherein the at least two conveyor devices are adapted for guiding the drill string in a curved path between the first direction and the second direction.

3. The drilling system according to claim 1, wherein each of the at least two conveyor devices comprises at least two rollers for guiding the drill string.

4. The drilling system according to claim 1, wherein each of the at least two conveyor devices comprises a groove for the drill string to run on.

5. The drilling system according to claim 1, wherein the second direction is arranged vertically.

6. The drilling system according to claim 1, wherein the first direction is arranged horizontally.

7. The drilling system according to claim 1, wherein the first direction is arranged with an inclination relative to a horizontal plane.

8. The drilling system according to claim 1, comprising a top drive for exerting a torque around the first direction on the end of the drill string.

9. The drilling system according to claim 1, comprising at least one rack for holding at least one segment of the drill string while performing a round trip, the rack being arranged parallel to the first direction.

10. A maritime vessel comprising at least one drilling system of claim 1.

11. The maritime vessel according to claim 10, wherein the first direction of the at least one drilling system is arranged longitudinally in relation to the maritime vessel.

12. The maritime vessel according to claim 10, comprising at least two drilling systems arranged vertically on top of each other.

13. The maritime vessel according to claim 12, wherein the at least two drilling systems have a common second direction.

14. The maritime vessel according to claim 10, wherein the maritime vessel is a drillship.

15. The drilling system according to claim 1, wherein each of the at least two block and tackle systems comprises a travelling block drivable in the first direction.

16. A method of drilling a well bore using the drilling system of claim 1 and a plurality of bendable drill pipes, each of the bendable drill pipes having a first end and a second end, the method comprising:

pushing a first bendable drill pipe with the at least two block and tackle systems and causing the first end of the bendable drill pipe to move initially in the first direction;

bending the first bendable drill pipe with the at least two conveyor devices while it is being pushed such that the first end of the first bendable drill pipe, after initially moving in the first direction, moves in the second direction that is both different than the first direction and aligned with the well bore being drilled;

attaching a second bendable drill pipe to the first bendable drill pipe, the attaching being accomplished by attaching the first end of a second bendable drill pipe to the second end of the first bendable drill pipe;

while it is attached to the first bendable drill pipe, pushing the second bendable drill pipe with the at least two block and tackle systems and causing the first end of the second bendable drill pipe to move in the first direction;

bending the second bendable drill pipe with the at least two conveyor devices while it is being pushed and while it is attached to the first bendable drill pipe such that the first end of the second bendable drill pipe changes direction and, after moving in the first direction, moves in the second direction.

17. The method of claim 16 further comprising rotating the first and second bendable drill pipes simultaneously.

18. The method of claim 16 further comprising applying torque to one of the first or second bendable drill pipes while it is being pushed.

19. The method of claim 16 wherein the first and second bendable drill pipes form a segment of a drill string and wherein the segment is guided in a curved path by the at least two conveyor devices.

20. The method of claim 19 wherein the at least two conveyor devices guide and bend the first bendable drill pipe and the second bendable drill pipe while the first bendable drill pipe and the second bendable drill pipe pass through the at least two conveyor devices.

21. The method of claim 20 further comprising rotating the drill string while one of the first and second bendable drill pipes is being bent.

22. The method of claim 19 further comprising:

after the first end of the first bendable drill pipe has begun to move in the second direction and before attaching the second bendable drill pipe to the first bendable drill pipe, fixing the first bendable drill pipe so it cannot move relative to the at least two conveyor devices; and attaching the second bendable drill pipe to the first bendable drill pipe after the fixing.

23. The method of claim 19 wherein the at least two conveyor devices is supported by a maritime vessel having a deck, and wherein the first direction is inclined at an angle that is less than 90 degrees relative to the deck.

24. The method of claim 23 wherein the second direction is inclined 90 degrees relative to the deck.

25. The method of claim 16 further comprising:

before attaching the second bendable drill pipe to the first bendable drill pipe, conveying the second bendable drill pipe from a first position in which it is supported on a rack and extending parallel to the first direction to a second position in which it is aligned with the first direction.

* * * * *